United States Patent [19]

DeFelice

[11] 4,053,077

[45] Oct. 11, 1977

[54] CHILD SAFETY CAP

[76] Inventor: Amedio DeFelice, c/o Banner Mold & Die Co., Inc., 251 Florence St., Leominster, Mass. 01453

[21] Appl. No.: 733,869

[22] Filed: Oct. 19, 1976

[51] Int. Cl.[2] ..... B65D 55/02; B65D 85/56

[52] U.S. Cl. ..... 215/217

[58] Field of Search ..... 215/216, 217, 218

[56] References Cited

U.S. PATENT DOCUMENTS 3,952,899 4/1976 Cooke ..... 215/217

3,979,001 9/1976 Bogert ..... 215/217

*Primary Examiner*—George T. Hall

*Attorney, Agent, or Firm*—Charles R. Fay

[57] ABSTRACT

A child safe cap for a container generally of the screw on type, and of the push and turn variety, wherein cap and container are provided with screw threads having interengaging ratchet-like teeth at portions thereof, preventing a turn of the cap in a direction to remove it, but including structure providing for pushing down upon the cap to release the teeth making it possible to turn the cap off.

8 Claims, 5 Drawing Figures

CHILD SAFETY CAP

BACKGROUND OF THE INVENTION

There have been proposals for child safe caps for instance for pill bottles and the like and many of these are of the screw thread push and turn variety. There have been objections that many of the push and turn type caps are difficult even for adults to remove and it is the object of the present invention to provide a construction which is more easily pushed and turned in order to open the container, while losing no part of the cap's safety function.

SUMMARY OF THE INVENTION

A bottle of plastic, glass, or other material having a threaded neck, preferably of a double lead type, and a cap cooperating therewith wherein cooperating screw threads are provided with a short series of interlocking teeth to lock the parts together in closed condition of the cap, but there being provided a looseness between the cap and the container which allows the cap to be pushed inwardly to release the teeth in order to allow removal of the cap in the usual manner by turning it in the left hand direction.

Resilient means are also provided for maintaining the teeth on the screw threads in engagement and resisting the push in action required to release the teeth to allow back off of the cap.

There is a stop provided for limiting the rotation of the cap relative to the container in seating the same in locked position thereon so that the threads do not get too greatly bound together. The teeth have angles with respect to the axis to the container, and the more the cap is turned, the more solidly the cap is locked in position.

PREFERRED EMBODIMENT OF THE INVENTION

Figure 1:
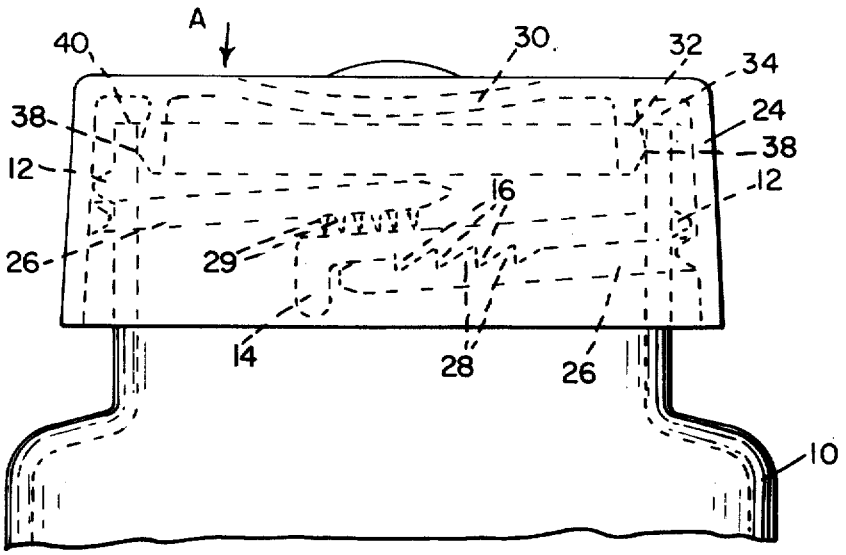
FIG. 1 is a view in elevation illustrating the invention with the cap in locked position.
Figure 2:
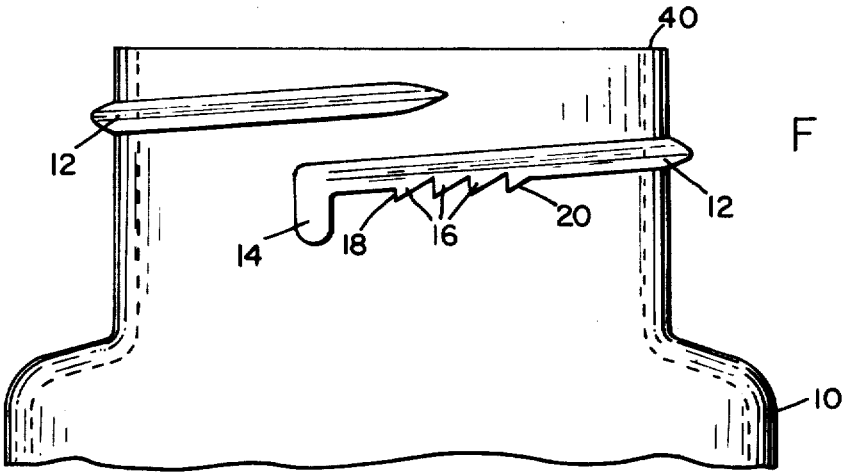
FIG. 2 is a view in elevation illustrating the threads, locking teeth, and stop on the container.
Figure 3:
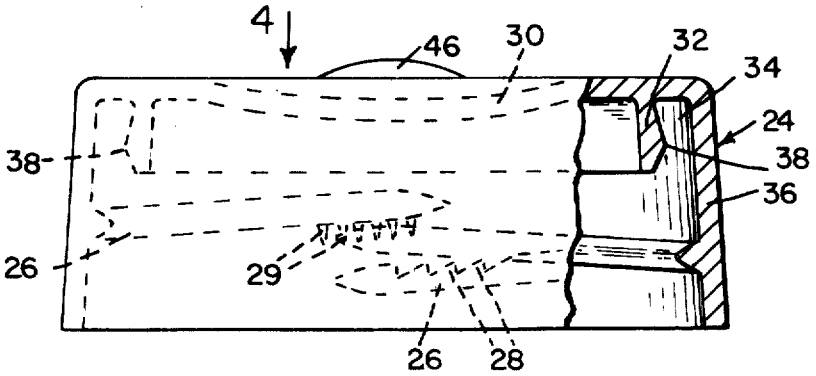
FIG. 3 is a view in elevation illustrating the construction of the cap.
Figure 4:
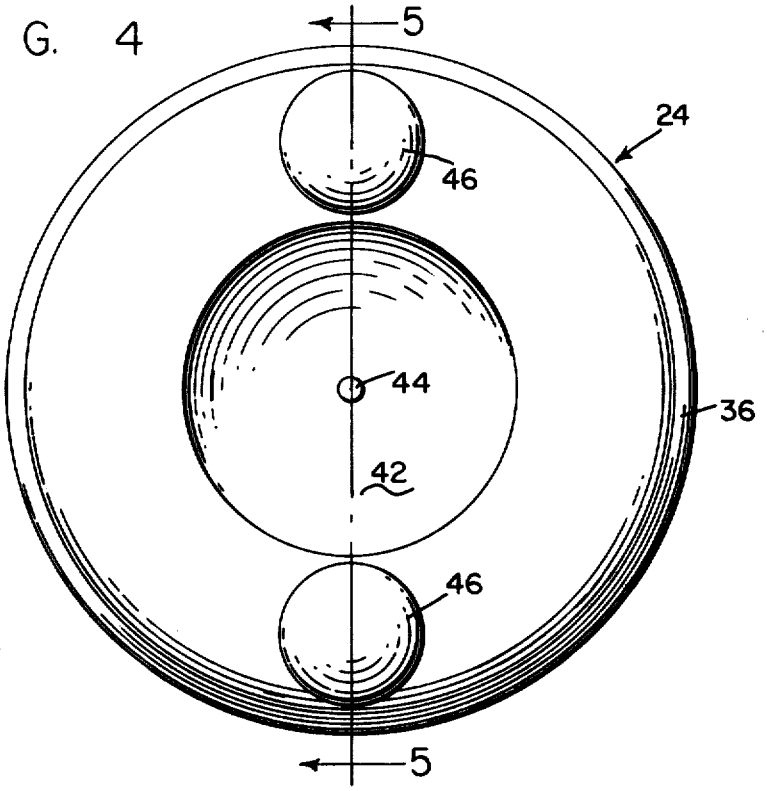
FIG. 4 is a top plan view, looking in the direction of arrow 4 in FIG. 3.
Figure 5:
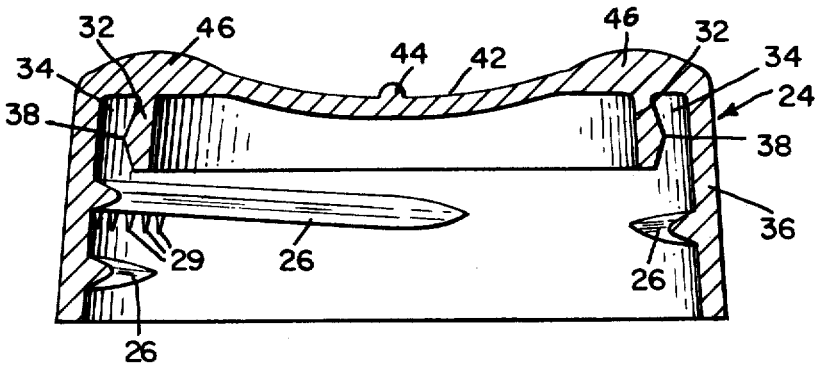
FIG. 5 is a section on line 5—5 of FIG. 4.

A container 10 of any suitable material is provided with double lead screw threads 12,12. Each of these threads is provided with a down turned end stop 14 and a series of serrations or teeth. These teeth are of a type similar to ratchet teeth or the rip teeth of a saw having a substantially longitudinal short edges 18 and longer edges 20 placed at an angle thereto.

A cap 24 is provided with complimentary double lead threads 26 having cooperating but reversed teeth 28. These are interior threads and those on the container of course are exterior. The upper thread is provided with small resilient fingers 29 which extends downwardly from its lower surface. The cap has a closed top 30 and an annular down turned rim 32 leaving an annular space 34 between the same and the side wall 36 of the cap. The rim 32 has an annular lip or ridge 38 that seals the container in concert with the inner wall of the neck thereof.

The action of the cap will be understood from FIG. 1. The cap is applied and turned in the usual manner in order to set the teeth 28 on the cap in locked engagement with the corresponding teeth 16 on the container. It will be noticed that these teeth can slip over each other so that it is easy enough to close the container using the single normal motion ordinarily used to seat the cap were these teeth not present. The cap can be turned no further however due to the abutment 14 for the end of the thread 12 on the container, so that although the threads are on an angle with regard to the axis of the container as shown in FIG. 1 they cannot lock to any further degree nor become jammed.

The fingers 29 maintain the teeth in engagement when the threads are turned to the FIG. 1 position until such time as the cap is pushed in the direction of the arrow A, FIG. 1. This displacement is allowed by the space 34 between the bottom 30 of the cap and the top edge 40 of the container.

When it is desired to open the container the cap is depressed as stated against the resiliency of the fingers 29 disengaging teeth 28 from teeth 16 and allowing the reverse turning and back off of the cap. The fingers 29 may originally be made with different lengths and degrees of resiliency for various applications, and they regulate the degree of pressure needed to release the teeth.

The cap has a center depression 42 that accommodates the spur 44 left from breaking off the spur in the manufacture of the cap, so that this spur will not irritate the palm of the hand as it pushes down on it.

The cap also has a pair of diametrically opposite protuberances 46,46 that are located over the teeth 28 to further make the depression of the cap to release the teeth as easy and comfortable as possible.

I claim

1. The combination of a container and a child safety cap for the container, an exterior screw thread on the container and a corresponding interior screw thread on the cap, interengaging teeth on said screw threads locking the cap in position on the container in closed condition thereof, resilient means holding the cap in position with the teeth engaged, said resilient means being deformable upon pressing in of the cap with relation of the container to disengage the teeth allowing separation of the cap from the container by rotating the same in the appropriate direction, said resilient means comprising fingers on the screw threads on the cap located substantially in the area of the teeth of the screw thread on the container.

2. The combination of claim 1 including a stop on the screw thread on the container limiting the amount of rotation of the cap relative to the container in a direction to lock the same.

3. The combination of claim 1 wherein the screw threads are of the double lead type.

4. The combination of claim 1 including a rim on the inside of the cap, said rim being spaced inwardly from the edge of the cap and fitting within the container.

5. The combination of claim 1 wherein the teeth are corresponding slanted to facilitate turning of the cap on the container in a closing direction.

6. The combination of claim 1 including a depending rim in the cap, said rim being continuous and spaced inwardly from the edge of the cap, and means on the rim engaging the interior of a portion of the container with the cap in place thereon.

7. The combination of claim 1 wherein the cap has a solid top with a pair of protuberances thereon adjacent the edge thereof at diametrically opposite positions aligned with the teeth on the cap.

8. The combination of claim 1 including a depression in the top of the cap centrally thereof, the spur left from the sprue formed during manufacture of the cap being located in the hand depression.

* * * * *